US010851536B2

(12) United States Patent
Vanker et al.

(10) Patent No.: US 10,851,536 B2
(45) Date of Patent: Dec. 1, 2020

(54) BALCONY INSTALLATION

(71) Applicant: PatCo LLC, Arvada, CO (US)

(72) Inventors: John Louis Vanker, Denver, CO (US); Michael Lastowski, Centennial, CO (US)

(73) Assignee: PATCO, LLC, Arvada, CO (US)

( * ) Notice: Subject to any disclaimer, the term of this patent is extended or adjusted under 35 U.S.C. 154(b) by 0 days.

(21) Appl. No.: 16/025,200

(22) Filed: Jul. 2, 2018

(65) Prior Publication Data

US 2019/0003172 A1 Jan. 3, 2019

Related U.S. Application Data

(60) Provisional application No. 62/527,301, filed on Jun. 30, 2017.

(51) Int. Cl.

| | |
|---|---|
| ***E04B 1/00*** | (2006.01) |
| ***E04B 1/34*** | (2006.01) |
| ***E04B 1/24*** | (2006.01) |

(52) U.S. Cl.

CPC ..... *E04B 1/003* (2013.01); *E04B 1/24* (2013.01); *E04B 1/34* (2013.01); *E04B 2001/246* (2013.01); *E04B 2001/2415* (2013.01); *E04B 2001/2451* (2013.01); *E04B 2001/2457* (2013.01); *E04B 2001/2466* (2013.01); *E04B 2001/2496* (2013.01)

(58) Field of Classification Search

CPC ... E04B 1/003; E04B 1/24; E04B 1/34; E04B 2001/2451; E04B 2001/2496; E04B 2001/246; E04B 2001/2415; E04B 2001/2457; E04B 2001/2466

See application file for complete search history.

(56) References Cited

U.S. PATENT DOCUMENTS

| | | | | |
|---|---|---|---|---|
| 4,811,542 | A | 3/1989 | Jewell | |
| 5,242,239 | A | 9/1993 | Hosokawa | |
| 6,739,099 | B2 * | 5/2004 | Takeuchi | E04B 1/2403 403/403 |
| 2016/0215491 | A1 * | 7/2016 | Haughton | E04B 1/003 |

FOREIGN PATENT DOCUMENTS

DE 20 2005 002 790 U1 6/2006

OTHER PUBLICATIONS

International Search Report issued for Application No. PCT/US20187/040555 dated Sep. 13, 2018.

* cited by examiner

*Primary Examiner* — Patrick J Maestri

(74) *Attorney, Agent, or Firm* — Holzer Patel Drennan

(57) ABSTRACT

A balcony includes a balcony assembly and a structural post and outrigger system. The structural posts provide structural support for buildings and include the outriggers that extend substantially perpendicularly from the structural posts to a location where the balcony assembly will be installed. The outriggers include a tube or beam and an end plate on an end of the beam distal from the structural post. The balcony assembly includes at least one long beam, a platform, and a locking mechanism on an end of the long beam. The locking mechanism includes a channel for receiving and securing the end plate of the outrigger. The balcony assembly is secured to the outrigger using fasteners.

19 Claims, 13 Drawing Sheets

BALCONY INSTALLATION

CROSS-REFERENCE TO RELATED APPLICATIONS

The present application is a Non-Provisional patent application, which claims benefit of U.S. Provisional Application Ser. No. 62/527,301 entitled "BALCONLY INSTALLATION," and filed on 30 Jun. 2017, which is incorporated herein by reference in its entirety.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

The present application discloses a balcony assembly including at least one beam, a locking mechanism attached to an end of the at least one beamy for receiving and securing an end plate of an outrigger of a structural post, and a platform positioned on top of the at least one beam.

BRIEF DESCRIPTIONS OF THE DRAWINGS

DETAILED DESCRIPTIONS

Some residential and commercial buildings include balconies or other types of raised platforms. When these buildings are constructed, beams or other structural components that provide structural support for balconies are attached to interior structural components. For example, a beam supporting a balcony may extend from support structures in the interior of the building. Because the structural components extend from the interior of the buildings, building design and construction is complex and expensive. Furthermore, when materials, such as drywall, are installed on the buildings, the components installed for supporting balconies may frustrate installation, because personnel have to work around these components using scaffolding or lift systems (e.g., mobile elevated work platforms).

Implementations described herein provide a balcony that may be pre-fabricated and easily installed. The balcony system includes a balcony assembly and a structural post and outrigger system. The structural posts provide structural support for buildings and include the outriggers that extend substantially perpendicularly from the structural posts to a location where the balcony assembly will be installed. The outriggers include a tube or beam and an end plate on an end of the tube/beam. The balcony assembly includes at least one long beam, a platform, and a locking mechanism on an end of the long beam. The balcony assembly is prefabricated according to design specifications. The balcony assembly may be positioned (e.g., lowered) into place where the outriggers are positioned. The locking mechanism receives the end plate of the outrigger and frictionally secures the balcony assembly to the outrigger (and thus the structural post). The balcony assembly is further secured using fasteners that are inserted through the locking mechanism and the end plate of the outriggers. A space is provided between the balcony assembly and the structural posts where materials, such as drywall, may be installed. In some example implementations, the balcony is a cantilevered balcony.

Figure 1:
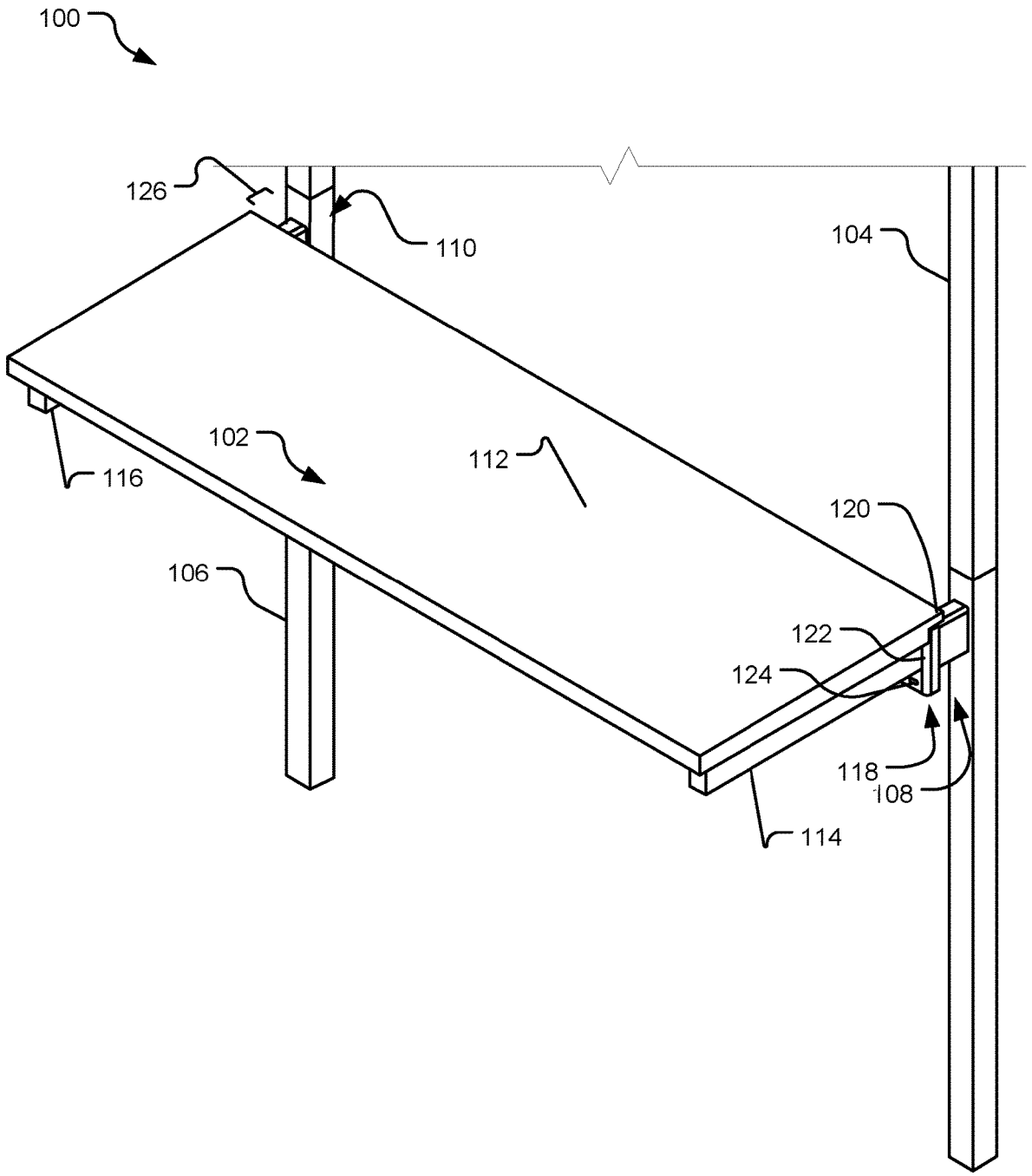
FIG. 1 illustrates an example implementation of a balcony.

FIG. 1 illustrates an example implementation of a balcony 100. The balcony 100 includes a balcony assembly 102 (hereinafter "balcony assembly 102") and structural posts 104 and 106. The structural posts 104 and 106 include outriggers 108 and 110. The structural posts 104 and 106 are structural components of a building such as an apartment building or commercial building. The structural posts 104 and 106 may be tube steel (TS), hollow structural sections (HSS), square hollow sections (SHS), rectangular hollow sections (RHS), circular hollow sections (CHS), etc. The outriggers 108 and 110 are used to attach the balcony assembly 102 to the building and may be prefabricated with the structural posts 104 and 106 or welded to the structural posts 104 and 106. Beams of the outriggers may be constructed using TS, HSS, etc.

The balcony assembly 102 is a prefabricated balcony that is attached to the structural posts 104 and 106 during construction of the building. The balcony assembly 102 is illustrated as a rectangular shape, but it should be understood that other balcony shapes are contemplated. Furthermore, the implementations described herein are discussed with respect to a balcony, but it should be understood that the implementations described may be utilized with any type of platform or elevated platform. The balcony assembly includes a platform 112, long beams 114 and 116, and locking mechanisms (e.g., a locking mechanism 118). In some example implementations, the platform 112 is a concrete platform. In such an implementation, the long beams 114 and 116 include word studs (not shown) that extend into the concrete. In other words, the concrete slab is formed on top of the long beams 114 and 116 such that the word studs extend into the slab, thus securely fastening the concrete slab to the long beams 114 and 116. The long beams 114 and 116 may be constructed using TS, HSS, etc.

The long beams 114 and 116 of the balcony assembly 102 include locking mechanisms (such as the locking mechanism 118) an end proximal to the structural posts 104 and 106. The locking mechanisms are used to securely attach the balcony assembly 102 to the outriggers 108 and 110. For example, the locking mechanism 118 is welded to, or prefabricated as a part of, the long beam 114. As such, the platform 102 is positioned partially on top of the locking mechanism 118 (as shown by a section 120). The locking mechanism 118 includes a c-shaped body 122 and metal block (not shown). The metal block is welded to, or formed as a port of the c-shaped body 122. The metal block frictionally attaches the top of the locking mechanism 118 (and thus the long beam 114) to the outrigger 108. The c-shaped body 122 further includes a pilot hole 124 that is configured to receive a fastener (not shown), such as a bolt. The outrigger 108 further also includes a pilot hole (not shown) that is configured to receive the fastener. Thus, when the balcony assembly 102 is positioned on the outriggers of the structural posts 104 and 106, fasteners are inserted into the pilot holes of the locking mechanisms and outriggers and secured (e.g., using a nut) to securely fasten the balcony assembly 102 to the structural posts 104 and 106.

The locking mechanisms of the balcony assembly 102 and the outriggers 108 and 110 allow for the balcony assembly 102 to be placed into positioned using a crane or manpower. For example, a crane (not shown) lowers the balcony assembly 102 onto the outriggers 108 and 110. The locking mechanisms of the balcony assembly 102 are positioned to receive end plates (not shown) of the outriggers 108 and 110. Once the end plates of the outriggers 108 and 110 are securely positioned within the c-shaped bodies (e.g., the c-shaped body 122) of the locking mechanisms, the balcony assembly 102 is securely attached to the structural posts 104 and 106 using the fasteners.

After the balcony assembly 102 is attached to the structural posts 104 and 106, drywall or other building components or materials (e.g., bricks, vinyl, wood, stucco) may be installed between the balcony assembly 102 and the structural posts 104 (e.g., a space 126). Thus, the outrigger includes a beam or tube that defines a space between the structural posts 104 and 106 and the balcony assembly.

Figure 2:
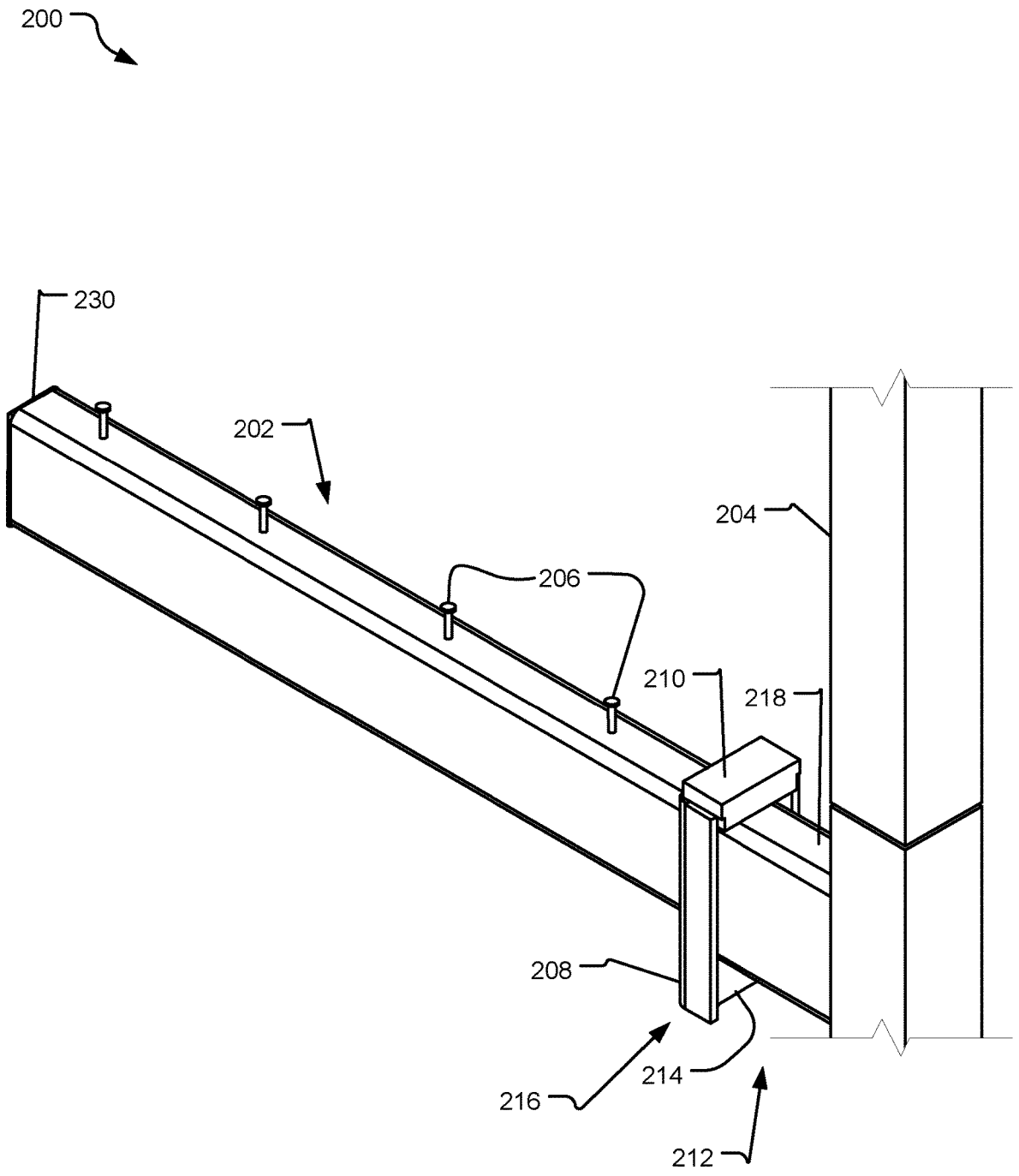
FIG. 2 illustrates an example long beam for use in a balcony described herein.

FIG. 2 illustrates an example long beam 202 for use in a balcony described herein. Specifically, FIG. 2 illustrates the long beam 202 of a balcony assembly attached to the structural post 204. The long beam 202 is attached to an outrigger 212 of the structural post 204 using a locking mechanism 216. The locking mechanism 216 is welded to (or fabricated as a part of) of the long beam 202. The locking mechanism 216 includes a c-shaped body 208 and a metal block 210. The metal block 210 is welded to the c-shaped body 208.

The outrigger 212 is welded to (or fabricated as a port of) the structural post 204. The outrigger 212 includes a tube 218 and an end plate 214. The end plate 214 may be welded to (or fabricated as a port of) the tube 218. The c-shaped body 208 of the locking mechanism 216 is shaped to receive the end plate 214 in a recessed portion of the c-shaped body 208. Furthermore, the end plate 214 extends upwards behind a recessed portion (not shown) of the metal block 210. As such, the metal block 210 is frictionally attached to the metal plate 214.

The long beam 202 includes a plurality of word studs (e.g., word studs 206) that are embedded in a concrete slab (not shown) of a balcony assembly. The long beam 202 further includes an end plate 214, which is positioned at an end distal to the structural post 204. After the locking mechanism is positioned on the end plate 214 of the outrigger 212, fasteners are inserted into pilot holes of the c-shaped body 208 and the end plate 214 to securely fasten the long beam 202 to the structural post 204. The long beam 202 further includes an end metal plate 230, which is positioned at an end distal to the structural post 204.

Figure 3:
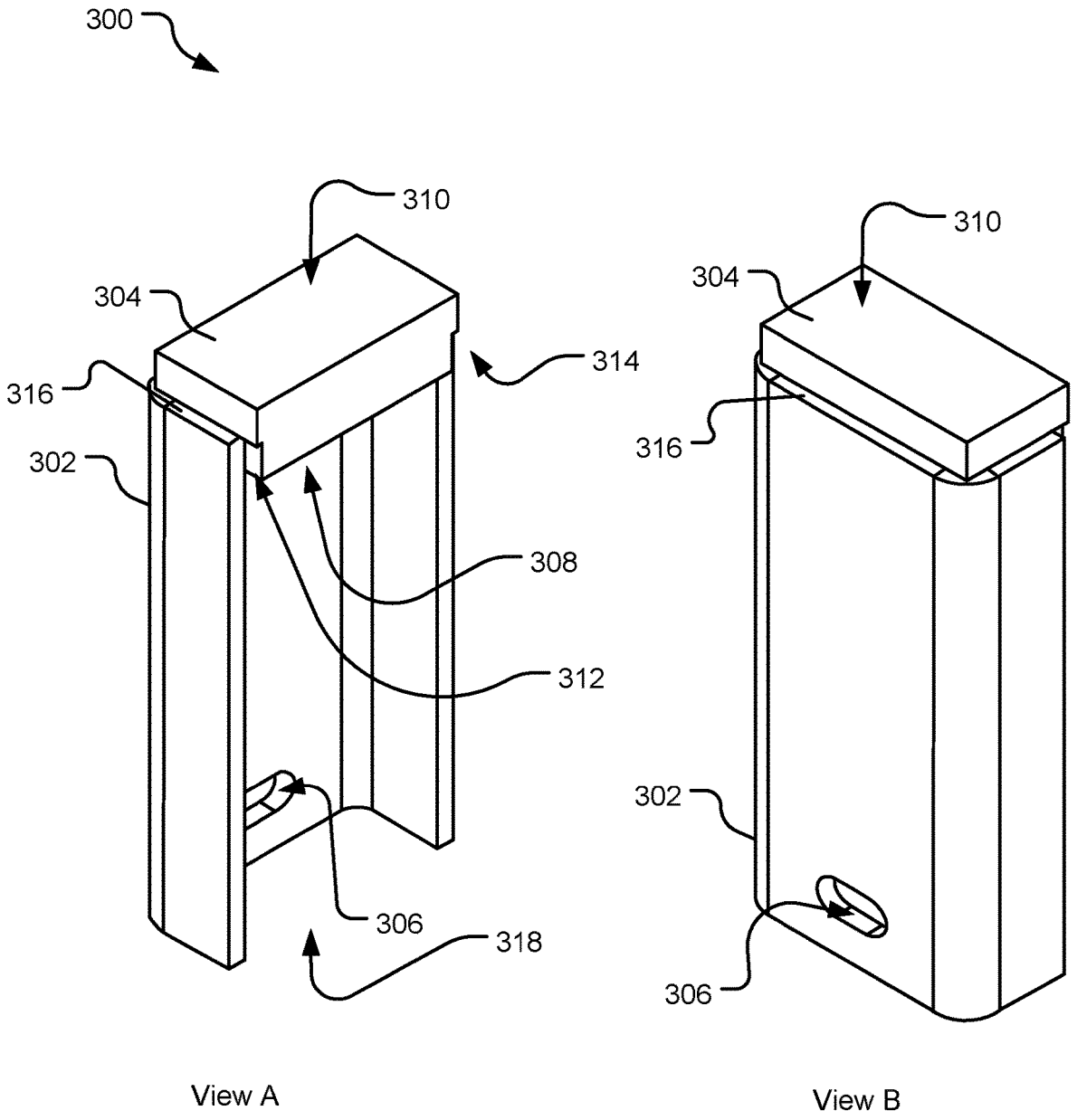
FIG. 3 illustrates various views of an example locking mechanism for use in an example balcony described herein.

FIG. 3 illustrates various views (e.g., view A and view B) of an example locking mechanism 300 for use in an example balcony (not shown) described herein. The locking mechanism 300 includes a c-shaped body 302, a metal block 304, and a pilot hole 306. The components of the locking mechanism 300 may be formed of, for example, galvanized steel. The c-shaped body 302 may be formed using a mold or a roll-forming machine. The c-shaped body may be a portion of a channel beam used in structures. In example implementations, the metal block 304 is formed using a mold. When implemented, the locking mechanism 300 is attached (e.g., welded) to a long beam (not shown) of a balcony assembly (not shown).

The metal block 304 is substantially box shaped and includes recessed portions 312 and 314 configured to allow the metal block 304 to extend into a channel formed by the c-shaped body 302. Furthermore, the portions of the blocks that are not recessed sit on a top edge 316 of the c-shaped body 302. The metal block 304 is securely attached (e.g., welded to) the c-shaped body 302. For example, an area around the top edge 316 of the c-shaped body 302 is welded to form a welded seam that attaches the metal block 304 to the c-shaped body 302. The seam under the metal block 304 may also be welded. Furthermore, a concrete slab (not shown) may be formed, with a portion positioned on top of (e.g., illustrated by an arrow 310) of the metal block 304. The metal block 304 further includes a bottom recessed portion (not shown), which is in the area illustrated by an arrow 308.

When used in association with a long beam and an outrigger of a building post, a channel 318 of the locking mechanism receives an end plate of the outrigger, the end plate extends into the bottom recessed portion of the metal block (e.g., in the area illustrated by the arrow 308). The end plate of the outrigger includes a pilot hole that is configured to align with the pilot hole 306 of the locking mechanism 300 when the locking mechanism 300 is correctly positioned on the end plate of the outrigger. A fastener is inserted through the pilot hole 306 of the locking mechanism and the pilot hole of the end plate of the outrigger to securely fasten the locking mechanism 300 to the outrigger.

Figure 4:
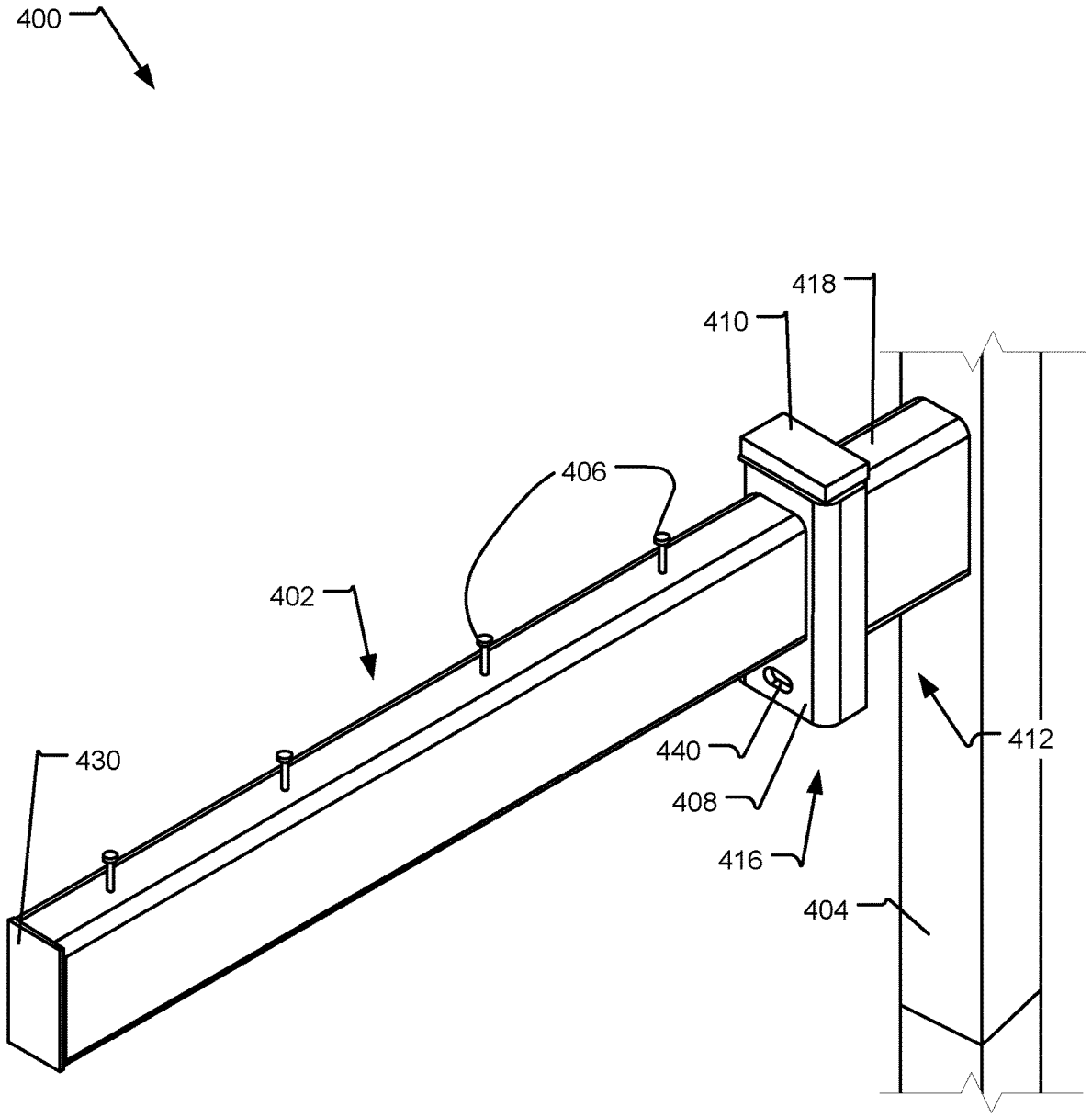
FIG. 4 illustrates another example long beam for use in a balcony described herein.

FIG. 4 illustrates an implementation 400 of an example long beam 402 for use in a balcony described herein. Specifically, FIG. 4 illustrates the long beam 402 of a balcony assembly attached to a structural post 404. The long beam 402 is attached to an outrigger 412 of the structural post 404 using a locking mechanism 416. The locking mechanism 416 is welded to (or fabricated as a part of) of the long beam 402. The locking mechanism 416 includes a c-shaped body 408 and a metal block 410. The metal block 410 is welded to the c-shaped body 408.

The outrigger 412 is welded to (or fabricated as a port of) the structural post 404. The outrigger 412 includes a tube 418 and an end plate (not shown in FIG. 4, such as the end plate 504 of FIG. 5). The end plate may be welded to (or fabricated as a port of) the tube 418. The c-shaped body 408 of the locking mechanism 416 is shaped to receive the end plate in a recessed portion of the c-shaped body 408. Furthermore, the end plate extends upwards behind a recessed portion (not shown) of the metal block 410. As such, the metal block 410 is frictionally attached to the end plate.

The long beam 402 includes a plurality of word studs (e.g., word studs 406) that are embedded in a concrete slab (not shown) of a balcony assembly. The long beam 402 further includes an end metal plate 430, which is positioned at an end distal to the structural post 404. After the locking mechanism is positioned on the end plate (not shown in FIG. 4, such as the end plate 504 of FIG. 5) of the outrigger 412, fasteners are inserted into a pilot hole 440 of the c-shaped body 408 and the end plate to securely fasten the long beam 402 to the structural post 404.

Figure 5:
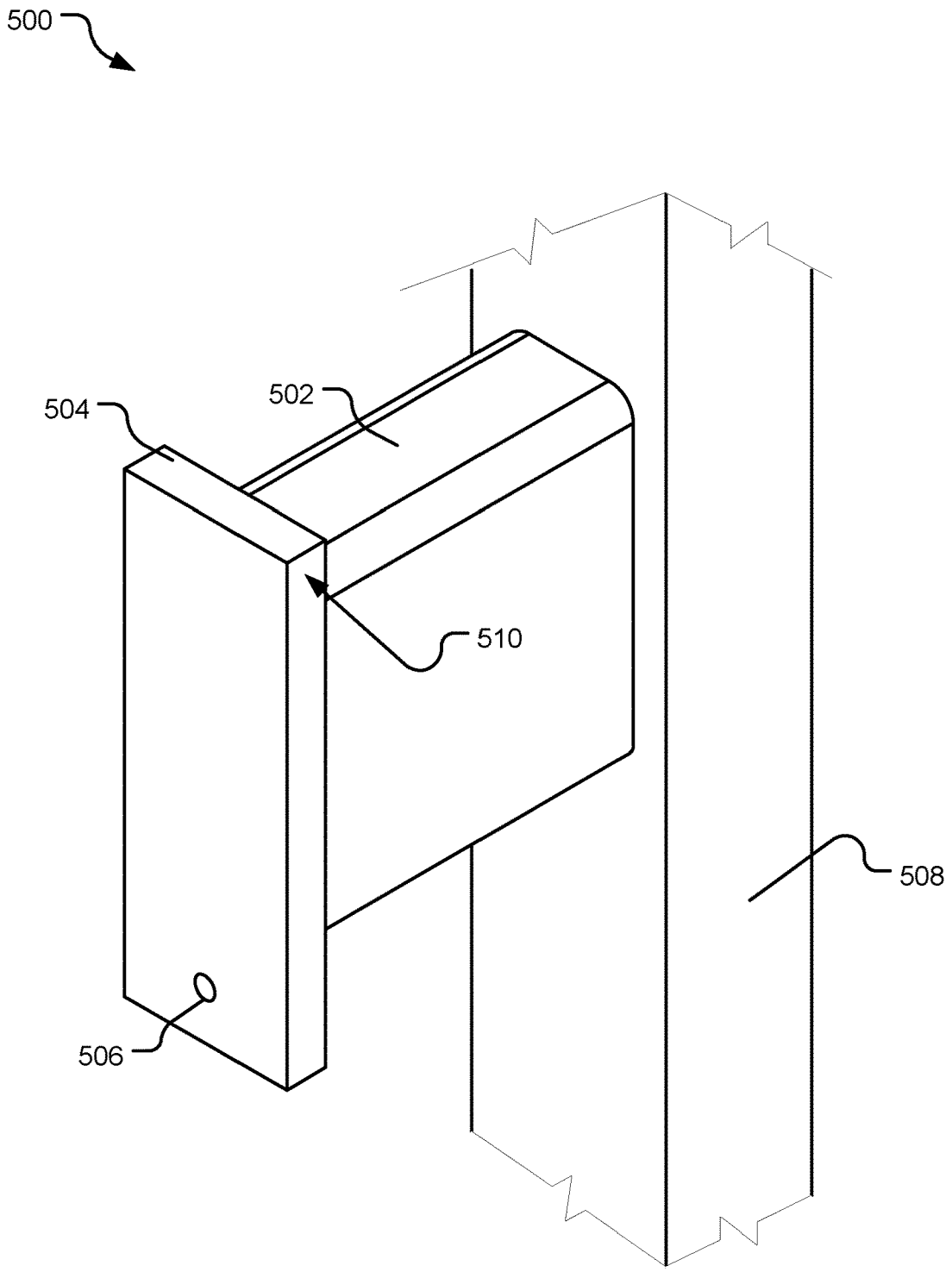
FIG. 5 illustrates an example outrigger for use with a balcony described herein.

FIG. 5 illustrates an example outrigger 500 for use with a balcony described herein. The outrigger 500 includes a tube 502 and an end plate 504. The tube 502 is securely attached to a structural post 508 of a building. The tube 502 may be welded or otherwise secured to the structural post 508 and extends substantially perpendicular to the structural post 508. In some implementations, the tube 502 is fabricated when the structural post 508 is fabricated. The end plate 504 is securely attached to the tube 502. The end plate may be welded to the tube 502. The end plate 506 includes a pilot hole 506 for receiving a fastener when a locking mechanism of a balcony assembly (not shown) is positioned on the end plate 504.

The end plate 504 is shaped to be inserted into a c-shaped body of a locking mechanism of a balcony assembly. Furthermore, the end plate 504 extends beyond the edge of the beam 502. A top extension 510 of the end plate is received in a recessed portion of a metal block of a locking mechanism of the balcony assembly.

Figure 6:
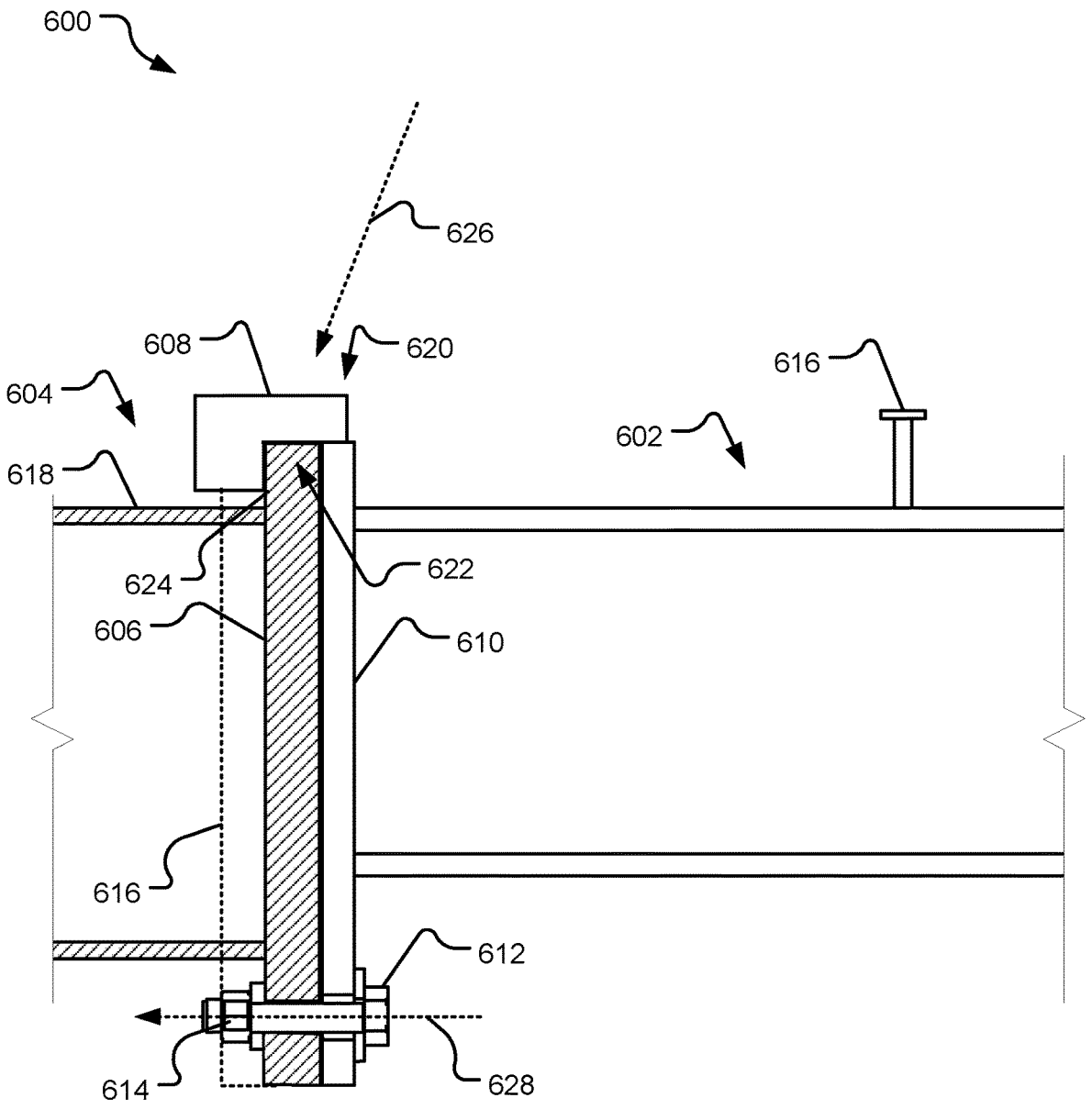
FIG. 6 illustrates a side cross-sectional view of a long beam of an example balcony attached to an example outrigger.

FIG. 6 illustrates a side cross-sectional view 600 of a long beam 602 of an example balcony attached to an example outrigger 604. The outrigger 604 includes a tube 618 attached to a structural post (not shown) of a building. The outrigger further includes an end plate 606, which is securely attached to the tube 618. A locking mechanism 620 is securely attached to the long beam 602. The locking mechanism 620 includes a metal block 608 and a c-shaped body 610. The c-shaped body 610 includes an inner edge 616, that defines a channel that receives the end plate 606. The c-shaped body 610 is shown as being transparent for illustrative purposes. The metal block 608 includes a bottom recessed portion 622 that receives a top edge 624 of the end plate 606.

When a balcony assembly is installed, the locking mechanism is lowered (e.g., generally in a direction illustrated by an arrow 626) onto the end plate 606 of the outrigger 604 such that the end plate 606 is received in the recessed portion 622 of the metal block 608. When the locking mechanism 620 is positioned on the end late 606 (e.g., the end plate 606 is received in the channel of the c-shaped body 610 and the top edge 624 of the end plate 606 is received in the recessed portion 622 of the metal block 608, the locking mechanism is securely fastened to the outrigger 604 using one or more fasteners (e.g., a fastener 612) inserted through a pilot hole of the c-shaped body 610 of the locking mechanism 620 and a pilot hole of the end plate 606 of the outrigger 604. In other words, the fastener 612 is inserted along an axis 628. The fastener 612 is secured with a nut 614.

Figure 7:
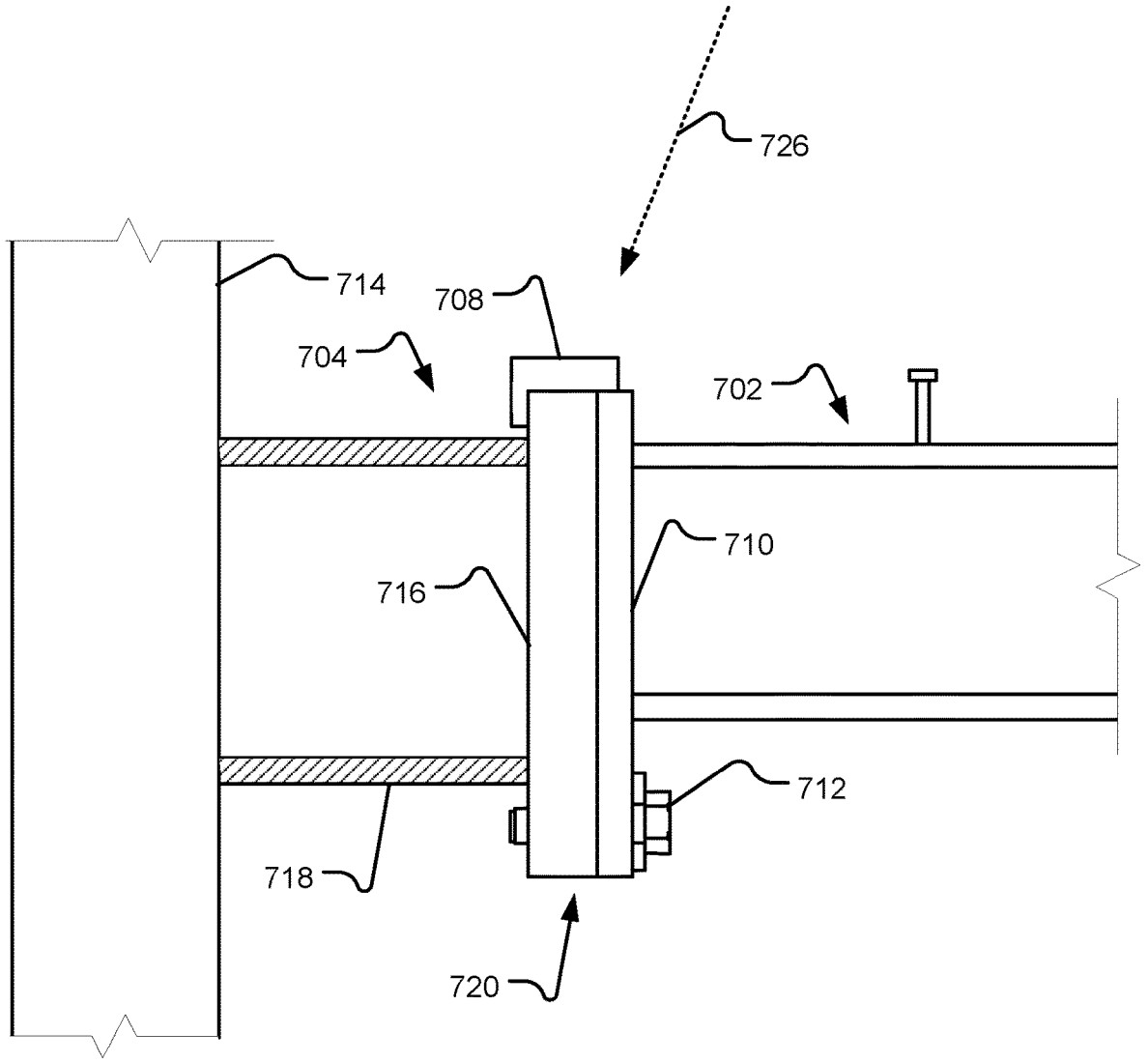
FIG. 7 illustrates a view of an example balcony attached to an outrigger.

FIG. 7 illustrates view 700 of a long beam 702 of an example balcony attached to an example outrigger 704. The outrigger 704 includes a tube 718 attached to a structural post 714 of a building or structure. The outrigger further includes an end plate (not shown), which is securely attached to the tube 718. A locking mechanism 720 is securely attached to the long beam 702. The locking mechanism 720 includes a metal block 708 and a c-shaped body 710. The c-shaped body 710 includes an inner edge 716, that defines a channel that receives the end plate 706. The metal block 708 includes a bottom recessed portion (not shown) that receives a top edge the end plate 706. When a balcony assembly is installed, the locking mechanism is lowered (e.g., generally in a direction illustrated by an arrow 726) onto the end plate of the outrigger 704 such that the end plate is received in the recessed portion 722 of the metal block 708. When the locking mechanism 720 is positioned on the end late 706 (e.g., the end plate is received in the channel of the c-shaped body and the top edge 724 of the end plate is received in the recessed portion of the metal block 708, the locking mechanism is securely fastened to the outrigger 704 using one or more fasteners (e.g., a fastener 712) inserted through a pilot hole of the c-shaped body 710 of the locking mechanism 720 and a pilot hole of the end plate of the outrigger 704.

Figure 8:
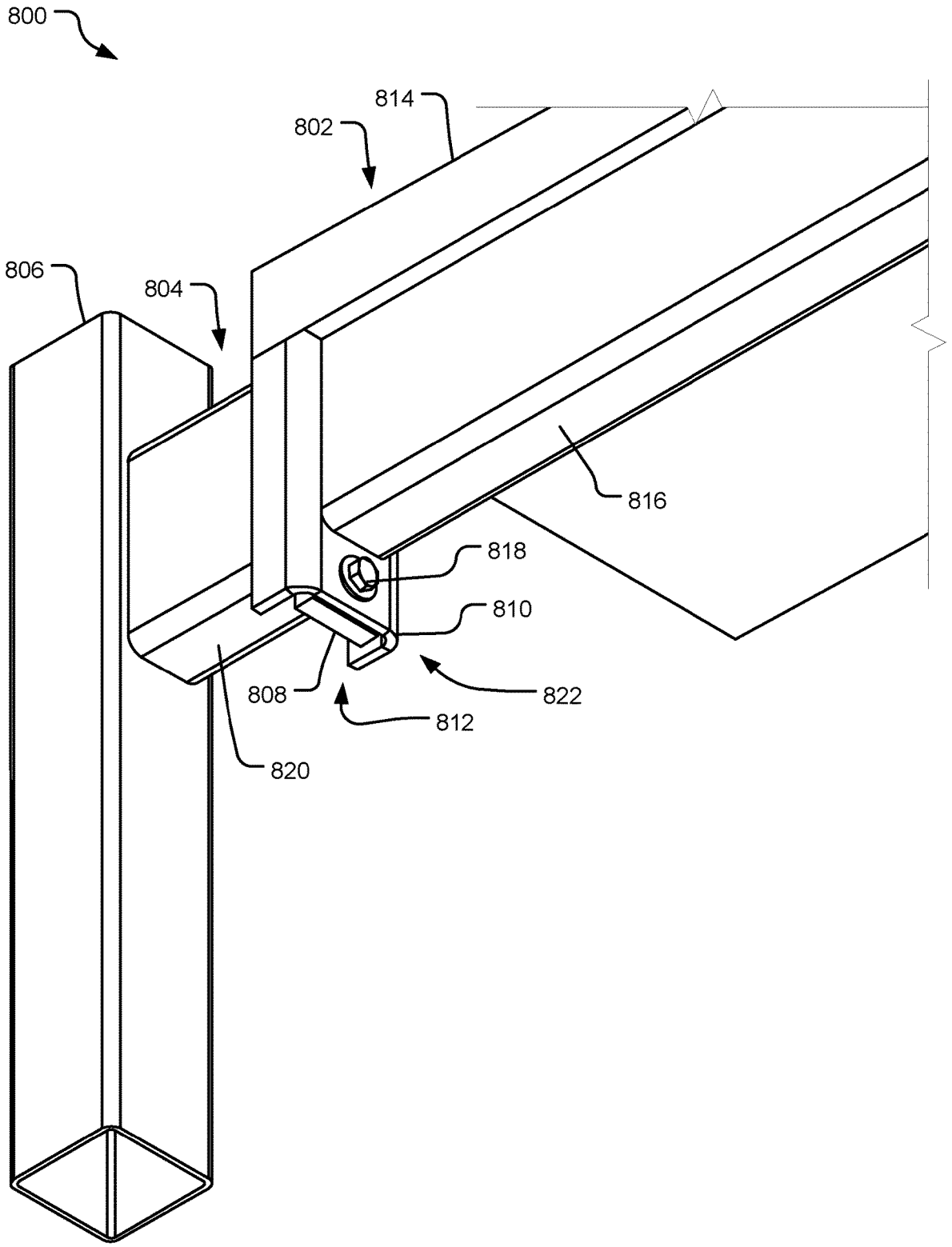
FIG. 8 illustrates a perspective view of an example balcony assembly attached to an outrigger of a structural post.

FIG. 8 illustrates a perspective view 800 of an example balcony assembly 802 attached to an outrigger 804 of a structural post 806. A tube 820 of the outrigger 804 is welded or otherwise permanently fastened to the structural post 806. An end plate 808 is welded to or otherwise permanently fastened to the tube 820 of the outrigger 804 at an end distal to the structural post 806. The tube 820 extends substantially perpendicularly from the structural post 804.

The balcony assembly 804 includes a platform 814, a long beam 816 and a locking mechanism 822. The locking mechanism 822 is welded to or otherwise permanently attached to an end of the long beam 816. The platform 816 is positioned on top of the long beam and may be formed of a concrete slab. In such an example implementation, the long beam includes word studs (not shown) that extend in a direction A (illustrated by an arrow 828) into the concrete slab. As such, the concrete slab is formed on top of the long beam 816 such that the concrete is formed around the word studs. Furthermore, the concrete slab is formed on top of the locking mechanism 822 to form the balcony assembly 802. The locking mechanism includes a c-shaped body 810 shaped to form a channel 812.

When the balcony assembly 802 is installed, the channel 812 of the c-shaped body 810 receives the end plate 808 of the outrigger 804. A top edge (not shown) of the end plate 808 is received in a recessed portion of a metal block (not shown) of the locking mechanism 822, thus frictionally attaching the balcony assembly 802 to the structural post 806. After the balcony assembly 802 is frictionally attached, the balcony assembly is secured to the outrigger 804 using a fastener 818, which is inserted through pilot holes of the c-shaped body 810 and the end plate 808 and secured with a nut, for example. Thus, the balcony assembly 802 is supported by the outrigger 804, locking mechanism 822, and the long beam 816.

Figure 9:
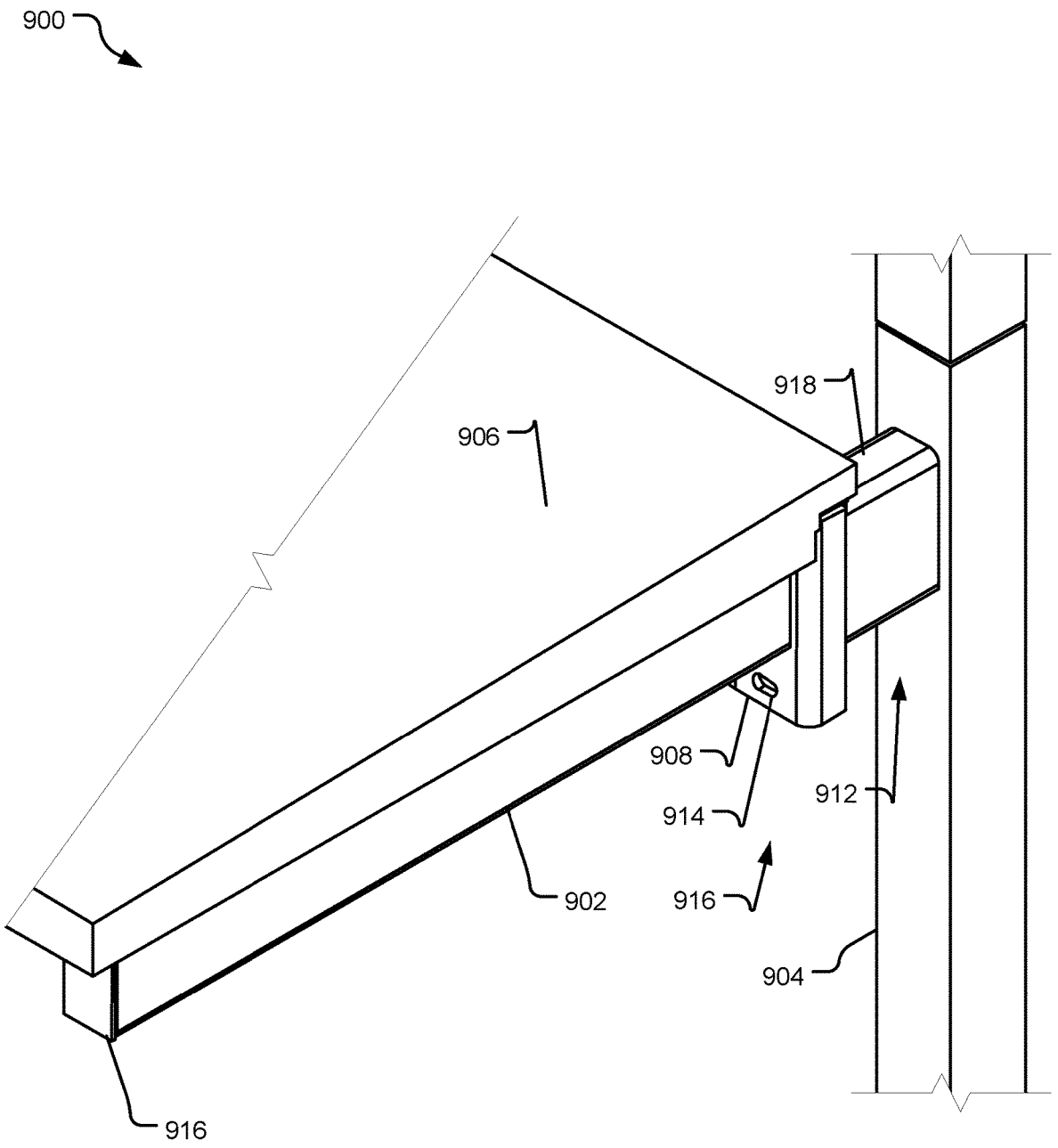
FIG. 9 illustrates a partial perspective view of an example balcony described herein.

FIG. 9 illustrates a partial perspective view of an example balcony 900 described herein. Specifically, FIG. 9 illustrates the long beam 902 of a balcony assembly attached to the structural post 904. The long beam 902 is attached to an outrigger 912 of the structural post 904 using a locking mechanism 916. The locking mechanism 916 is welded to (or fabricated as a part of) the long beam 902. The locking mechanism 916 includes a c-shaped body 908 and a metal block (not shown). The metal block is welded to the c-shaped body 908.

The outrigger 912 is welded to (or fabricated as a port of) the structural post 904. The outrigger 912 includes a tube 918 and an end plate (not shown). The end plate is welded to (or fabricated as a port of) the tube 918. The c-shaped body 908 of the locking mechanism 916 is shaped to receive the end plate in a recessed portion of the c-shaped body 908. Furthermore, the end plate extends upwards behind a recessed portion (not shown) of the metal block. As such, the metal block 910 is frictionally attached to the metal plate 914.

The balcony assembly includes a platform 906. The platform 906 may be formed of concrete and may be embedded with word studs (not shown) projecting from the top of the long beam 902. In some example implementations, the platform 906 slopes away from the structural post 904 to provide drainage for the platform 906. The long beam 902 further includes an end plate 916, which is positioned at an end distal to the structural post 904. After the locking mechanism is positioned on the end plate 914 of the outrigger 912, fasteners are inserted a pilot hole 914 of the c-shaped body 908 and the end plate 914 to securely fasten the long beam 902 to the structural post 904.

Figure 10:
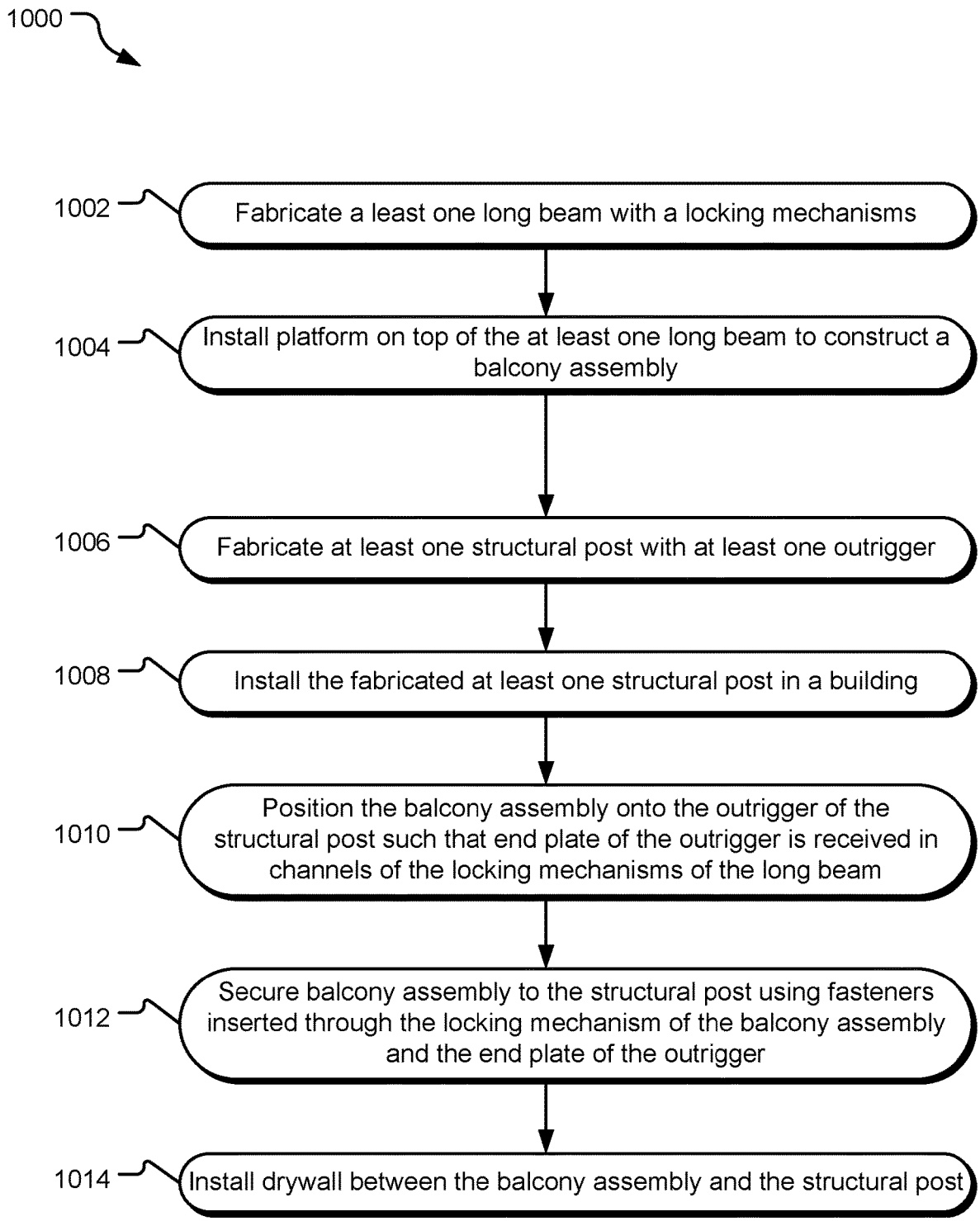
FIG. 10 illustrates example operations for installing an example balcony described herein.

FIG. 10 illustrates example operations 1000 for installing an example balcony described herein. A fabricating operation 1002 fabricates at least one long beams with locking mechanisms. The fabricating operation 1002 may include cutting the long beam to a desired length, welding the locking mechanism to a first end of the beam, welding an end plate to a second end of the beam, welding word studs to the beam, etc. Furthermore, the locking mechanisms may be pre-fabricated. Such pre-fabrication may include cutting a c-shaped body to a desired specification, cutting or punching a pilot hole, and welding a prefabricated (molded) metal block to the c-shaped body. The length of the long beams may be based on computer generated specifications according to a generated building design (e.g., an architectural design) using standardized structural parts.

An installing operation 1004 installs a platform on top of the at least one long beam to construct a balcony assembly. Such installation may include forming a mold on top of the at least one long beam, pouring wet concrete into the mold, and letting the concrete dry. In such an implementation, the long beams may include word studs that are embedded in the concrete to secure the concrete to the long beams. The fabricating operation 1002 and the installing operation 1004 (along with any intermediate operations) are for constructing the balcony assembly. The operations may be repeated for a number of balconies for a building and specifications (e.g., lengths, widths) may be based on design drawings generated by a computer. The operations may be automated using machines.

A fabricating operation 1006 fabricates at least at least one structural post with at least one outrigger. The fabricating operation 1006 may include cutting a beam/post to the desired post length, welding an outrigger with an endplate to the post (e.g., in a location where the balcony is intended to be located), etc. The post may include multiple outriggers for multiple balconies when the post extends between multiple floors of a building/structure. An installing operation 1008 installs the fabricated at least one structural post in a building. The installing operation 1008 may include attaching the structural post to other structural components such as columns, wall panels, other structural posts, ceiling and floor trusses, etc. In some example implementations, the outriggers are installed on (e.g., welded to) the structural post after the structural post is installed in the building.

A positioning operation 1010 positions the balcony assembly onto the outrigger of the structural post such that end plate of the outrigger is received in channels of the locking mechanism of the long beams of the balcony assembly. The positioning operation 1010 may include lowering the balcony assembly by hand and/or crane onto the outriggers. A securing operation 1012 secures the balcony assembly to the structural post using fasteners inserted through the locking mechanism of the balcony assembly and the end plate of the outrigger. In installing operation 1014 installs drywall (or other materials) between the balcony assembly and the structural post.

Figure 11:
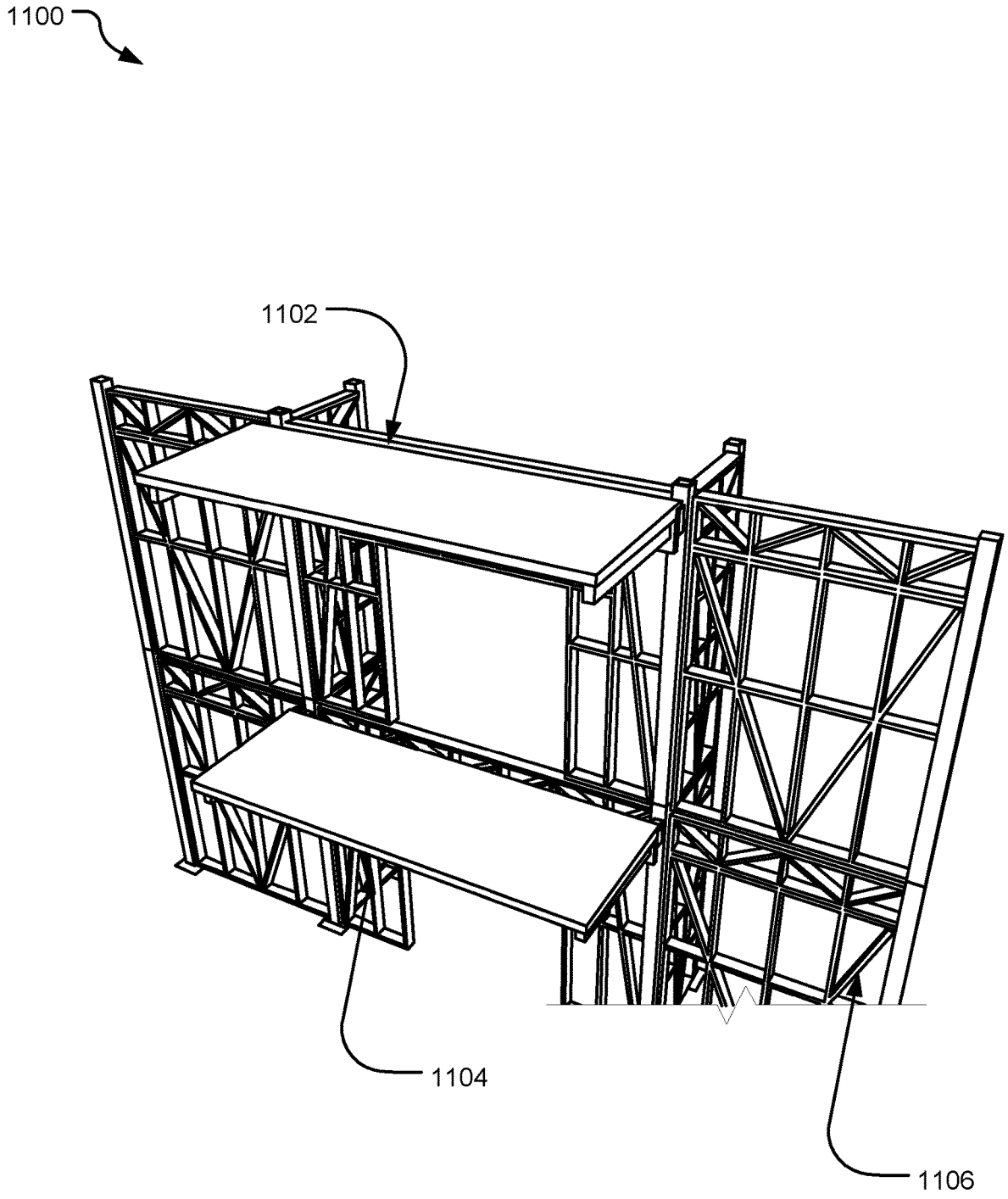
FIG. 11 illustrates example balconies as described herein installed on a partially illustrated stricture.

FIG. 11 illustrates example balconies 1102 and 1104 as described herein installed on a partially illustrated stricture 1106.

Figure 12:
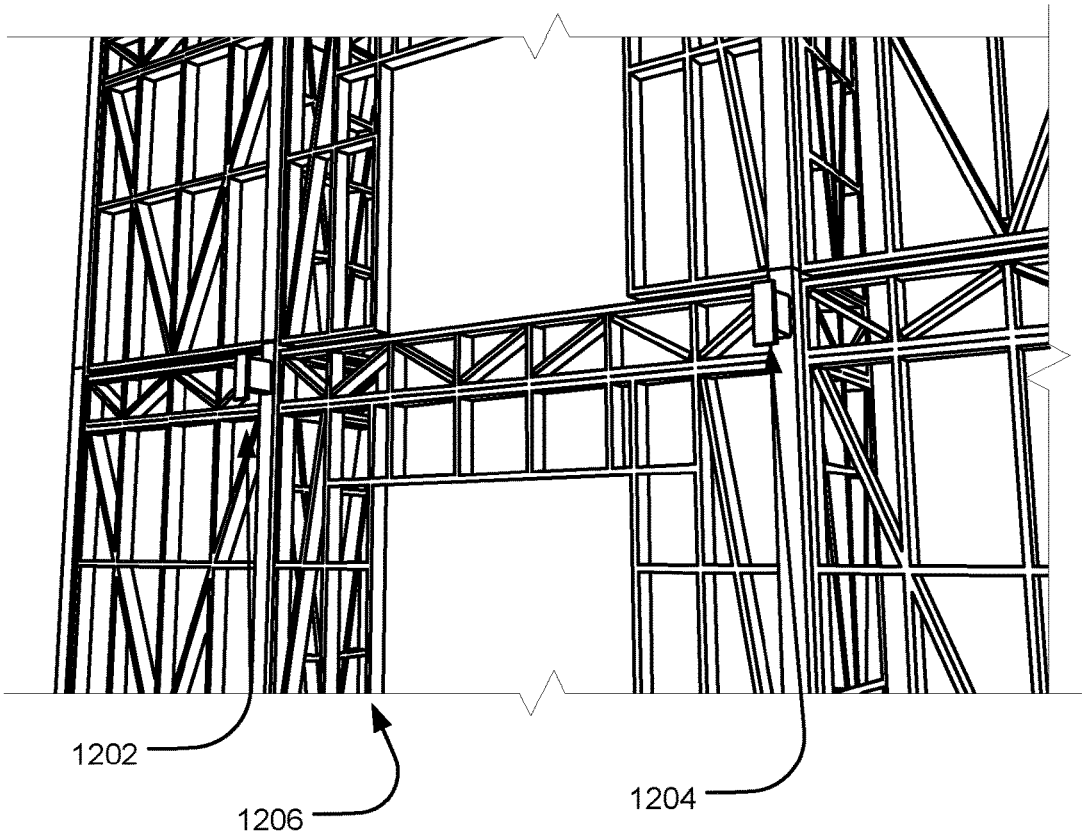
FIG. 12 illustrates example outriggers installed on a partially illustrated structure.

FIG. 12 illustrates example outriggers 1202 and 1204 installed on a partially illustrated structure 1206.

Figure 13:
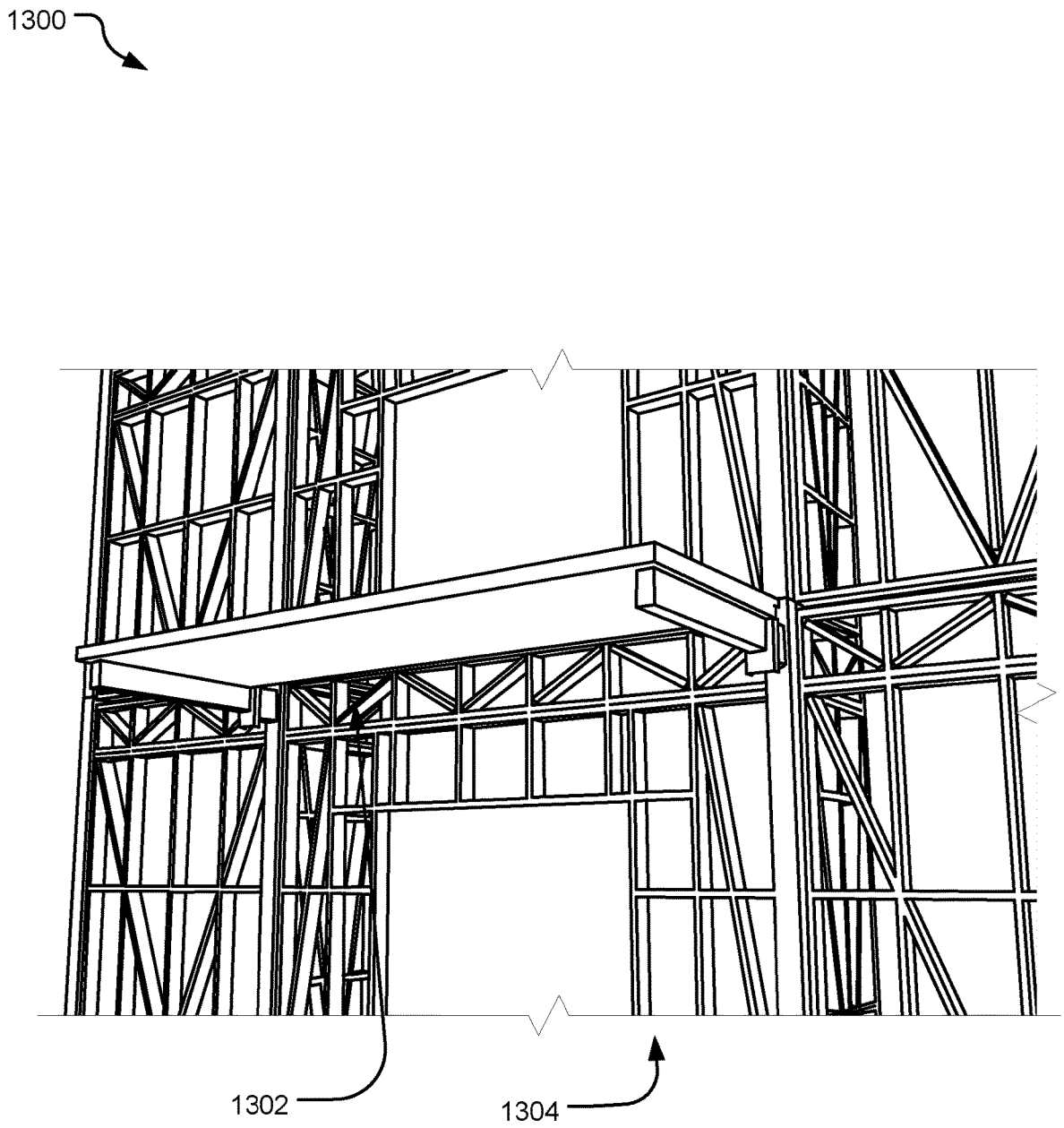
FIG. 13 illustrates an example balcony described herein installed on a partially illustrated structure.

FIG. 13 illustrates an example balcony 1302 described herein installed on a partially illustrated structure 1304.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims. Although the present invention has been described with reference to preferred embodiments, workers skilled in the art will recognize that changes may be made in form and detail without departing from the scope of the invention. The implementations described above and other implementations are within the scope of the following claims.

What is claimed is:

1. A balcony assembly comprising:

at least one beam;

a locking mechanism attached to an end of the at least one beam, the locking mechanism including a c-shaped body for receiving an end plate of an outrigger of a structural post, a metal block attached to the c-shaped body for securing the end plate, and a pilot hole in the c-shaped body for securing the at least one beam to the outrigger; and a platform positioned on top of the at least one beam.

2. The balcony assembly of claim 1, wherein the platform is made of concrete.

3. The balcony assembly of claim 1, wherein the pilot hole in the c-shaped body is configured to align with a pilot hole in the end plate of the outrigger.

4. The balcony assembly of claim 1, wherein the metal block of the locking mechanism is further configured to include a first recessed portion and a second recessed portion such that the metal block is configured to extend into a channel formed by the c-shaped body.

5. The balcony assembly of claim 4, wherein the metal block further comprising non-recessed portions that are configured to sit on a top edge of the c-shaped body.

6. The balcony assembly of claim 5, wherein an area around the top edge of the c-shaped body is welded to form a welded seam that attaches the metal block to the c-shaped body.

7. The balcony assembly of claim 4, wherein the c-shaped body is configured to receive the end plate of the outrigger extending into a recessed portion of the metal block.

8. The balcony assembly of claim 1, wherein the locking mechanism is welded to the at least one beam.

9. A system comprising:

a structural post;

an outrigger attached to the structural post, the outrigger extending substantially perpendicularly from the structural post and including an end plate, the end plate including an end plate pilot hole;

a balcony assembly including a beam, a locking mechanism attached to an end of the beam, and a balcony platform positioned on top of the beam, the locking mechanism including a c-shaped body that includes a channel that holds the end plate of the at least one outrigger, a metal block that secures the end plate, and a locking mechanism pilot hole; and a fastener inserted through the locking mechanism pilot hole and the end plate pilot hole to secure the balcony assembly to the outrigger, wherein the end plate of the outrigger extends into a recessed portion of the metal block.

10. The system of claim 9, wherein the balcony platform positioned on top of the beam is made of concrete.

11. The system of claim 9, wherein the metal block including a first recessed portion and a second recessed portion such that the metal block is configured to extend into a channel formed by the c-shaped body.

12. The system of claim 11, wherein the metal block further comprising non-recessed portions that are configured to sit on a top edge of the c-shaped body.

13. The system of claim 12, wherein an area around the top edge of the c-shaped body is welded to form a welded seam that attaches the metal block to the c-shaped body.

14. The system of claim 9, wherein the locking mechanism is welded to the at least one beam.

15. A method comprising:

fabricating a balcony assembly including a beam, a locking mechanism attached to an end of the beam, and a platform positioned on top of the beam, the locking mechanism including a c-shaped body that includes a channel, a metal block, and a locking mechanism pilot hole;

installing a structural post that includes an attached outrigger, the outrigger extending substantially perpendicularly from the structural post and including an end plate on an end distal from the structural post, the end plate including an end plate pilot hole, wherein the end plate of the outrigger extends into a recessed portion of the metal block; and positioning the balcony assembly onto the outrigger, the channel of the locking mechanism receiving the end plate of the outrigger, the metal block of the locking mechanism securing the end plate.

16. The method of claim 15, further comprising securing the balcony assembly to the outriggers by inserting a fastener through the locking mechanism pilot hole and the end plate pilot hole.

17. The method of claim 16, further comprising positioning the platform on top of the beam.

18. The method of claim 16, further comprising installing a drywall between the balcony assembly and the structural post.

19. The method of claim 16, further comprising securing the balcony assembly to the structural post using fasteners inserted through the locking mechanism of the balcony assembly and the end plate of the outrigger.

* * * * *